US007290674B1

(12) United States Patent
Ledford

(10) Patent No.: US 7,290,674 B1
(45) Date of Patent: Nov. 6, 2007

(54) BIFURCATED TRASH BIN

(76) Inventor: Andrew K. Ledford, SDV Team One-ASDS 675 Lehua Ave. Bldg. 995, Pearl City, HI (US) 96782

( * ) Notice: Subject to any disclaimer, the term of this patent is extended or adjusted under 35 U.S.C. 154(b) by 209 days.

(21) Appl. No.: 10/956,699

(22) Filed: Sep. 29, 2004

(51) Int. Cl.
*B65D 1/24* (2006.01)
*B65D 90/00* (2006.01)
*B65D 1/36* (2006.01)

(52) U.S. Cl. ..... 220/507; 220/495.08; 220/526

(58) Field of Classification Search ..... 220/495.08, 220/526, 909, 507, 322, 524
See application file for complete search history.

(56) References Cited

U.S. PATENT DOCUMENTS 3,519,306 A 7/1970 Young
3,924,889 A 12/1975 Gogush
4,158,424 A * 6/1979 Carmack ..... 220/826
D275,618 S 9/1984 Agard
4,753,367 A * 6/1988 Miller et al. ..... 220/495.11
4,834,253 A * 5/1989 Crine ..... 220/23.4
4,953,740 A * 9/1990 Koda ..... 220/263
5,072,852 A * 12/1991 Smith et al. ..... 220/495.09
D323,729 S 2/1992 Weiand
5,184,744 A * 2/1993 Paulison ..... 220/23.4
5,303,841 A 4/1994 Mezey
5,624,050 A 4/1997 Haas
6,129,233 A 10/2000 Schiller
6,196,407 B1 3/2001 Liu
6,378,721 B1 4/2002 Williams
6,386,386 B1 5/2002 George
6,443,516 B2 9/2002 Lambright
6,494,524 B2 12/2002 Lambright

* cited by examiner

*Primary Examiner*—Anthony D. Stashick
*Assistant Examiner*—Shawn M. Braden

(57) ABSTRACT

A bifurcated trash bin includes a rectangular housing having an open top portion and a closed bottom portion defining a cavity therein. A divider member is removably positionable along the top portion for bifurcating the cavity into a pair of substantially symmetric partitions. The trash bin further includes a plurality of rectangular lids pivotally connected to the housing and a plurality of bag-supporting members pivotally connected to the housing adjacent to the lids. A mechanism for maintaining the lids and the bag-supporting members at closed positions is disposed about a partial perimeter of the housing.

10 Claims, 2 Drawing Sheets

BIFURCATED TRASH BIN

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a trash bin and, more particularly, to a bifurcated trash bin for receiving and storing disposable items therein.

2. Prior Art

The use of trash bins are well known in the prior art. Regular trash containers are commonly made having only one holding space for collecting waste materials. For collecting differently classified waste materials, several garbage containers usually need to be used.

It appears that at least 50% of waste materials are recyclable and can be removed to significantly reduce the amount of solid waste that is disposed of in landfills. The recyclables may be re-used for economic advantage providing income to the waste collection agency. It is noted that the terms "refuse" and "waste" are used interchangeably to denote discarded materials which are generated by man.

During the last two or more decades the public collection of recyclables such as cans of various compositions, glass bottles, plastics, paper products and other nominal waste materials which can be recycled has come more and more to the fore. Public bodies such as municipalities, state and federal parks as well as corporate entities such as large companies and the like have undertaken to provide recycling and refuse receivers in public places to encourage the public to both dispose of their refuse and to aid in the collection of recyclables for further processing.

Unfortunately, many individuals are discouraged from recycling due to the fact that such recycling usually requires the maintenance of one or more recycling bins in addition to their regular trash bin. The locations of the trash and recycling bins, respectively, may be so far apart as well that some recyclables tend to end up in the regular trash bin because it is to time consuming to separate the trash and deposit each type in their respective bins.

Accordingly, a need remains for a bifurcated trash bin in order to overcome the above-noted shortcomings. The present invention satisfies such a need by providing a trash bin that is durable, versatile in use, compact in size, has aesthetic appeal, and is effective and easy to use. Such a trash bin makes the separation of paper, plastic, aluminum, cardboard and other recyclables from regular trash easy by providing both receptacles in one container. The bifurcated trash bin is neat and provides valuable space savings in the home as well as in garages and offices.

BRIEF SUMMARY OF THE INVENTION

In view of the foregoing background, it is therefore an object of the present invention to provide a bifurcated trash bin. These and other objects, features, and advantages of the invention are provided by an apparatus for receiving and storing disposable items therein.

The apparatus includes a generally rectangular housing provided with a centrally disposed longitudinal axis and further has an open top portion and a closed bottom portion axially spaced therefrom. Such a housing defines a cavity therein and includes a divider member removably positionable along the top portion wherein the divider member traverses the axis along a substantially horizontal plane. The divider member bifurcates the cavity into a pair of juxtaposed and substantially symmetric partitions for conveniently maintaining separate trash bags therein.

A plurality of rectangular lids are pivotally and independently connected to the housing adjacent to the top portion. Such lids are independently and selectively movable between raised and lowered positions along respective arcuate paths for covering the open top portion of the housing. The lids pivot about a first axis extending orthogonal to the longitudinal axis. The lids preferably include outer edge portions and a central surface integral therewith that is engageable with the lip portions (described herein below) and the lip protrusions (described herein below) when moved to lowered positions respectively.

A plurality of bag-supporting members are pivotally connected to the housing adjacent to the lids respectively. Such bag-supporting members are sized and shaped for independently extending about associated perimeters of the partitions wherein top edge portions of the trash bags can be selectively engaged with the bag-supporting members and securely held in place when the bag-supporting members are pivoted to lowered positions respectively. The bag-supporting members pivot about a second axis extending adjacent to the first axis and extending substantially parallel thereto.

A mechanism for maintaining the lids and the bag-supporting members at closed positions is disposed about a partial perimeter of the housing. Such a maintaining mechanism preferably includes a plurality of lip portions secured to the housing and extending upwardly therefrom. The lip portions are oppositely spaced from the divider member and extend substantially parallel thereto. Each such lip portion has a generally L-shape and includes a protrusion integrally disposed along a length thereof. The protrusions partially extend into the arcuate paths of the bag-supporting members so that a frictional force can be generated therebetween and advantageously hold the trash bags at operating positions. The divider member includes a plurality of protrusions extending along a length thereof for cooperating with the lip protrusions to support the trash bags at stable positions.

A plurality of stop members are connected to the housing and disposed adjacent to the top portion. Such stop members extend inwardly from a perimeter of the housing and define a platform above which the divider member is supported. The housing further has a plurality of slots formed therein vertically above the stop members wherein the slots are sized and shaped for mating with the divider member. Such a divider member has opposed end portions including integrally disposed flange portions extending outwardly and away therefrom for selectively fitting through the slots and resting on the stop members respectively so that the divider member can be maintained along the horizontal plane.

The apparatus may further include a plurality of levers pivotally attached to the housing adjacent to the front end portions of the partitions respectively. Such levers are for assisting a user to conveniently disengage the lids and the bag-supporting members upwardly and away from the housing during operating conditions respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
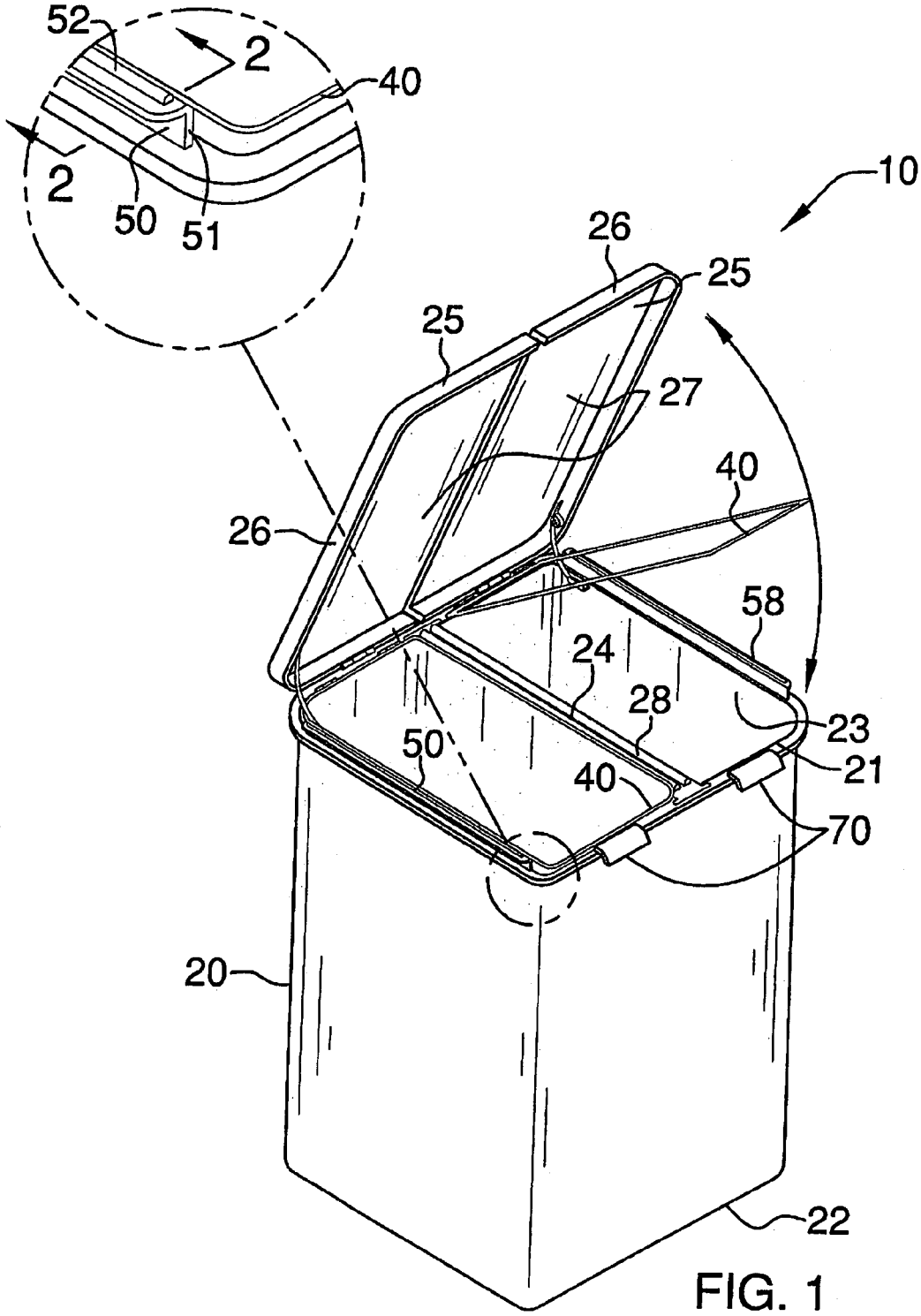
FIG. 1 is a perspective view showing a bifurcated trash bin for receiving and storing disposable items therein, in accordance with the present invention.
Figure 2:
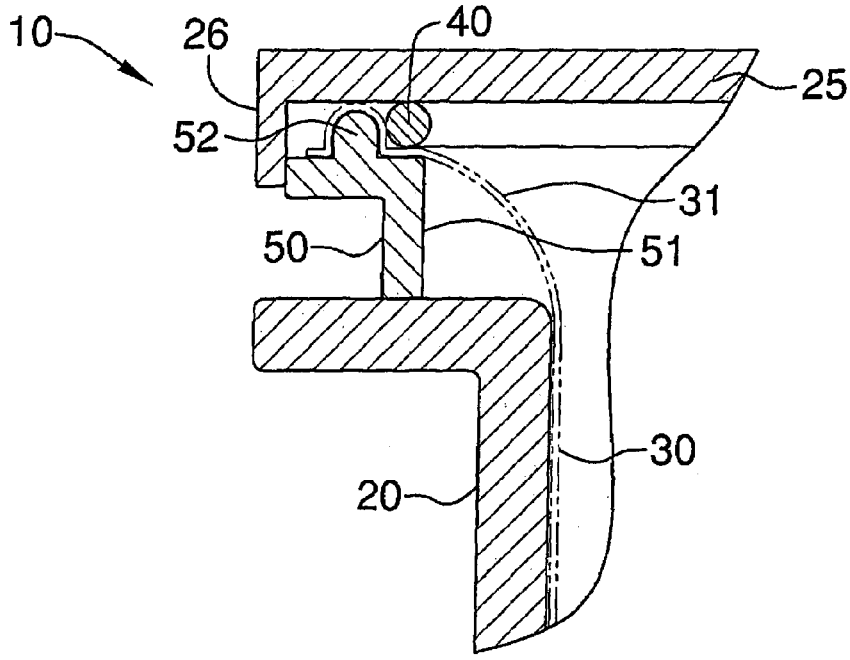
FIG. 2 is a cross-sectional view of the apparatus shown in FIG. 1, taken along line 2-2.
Figure 3:
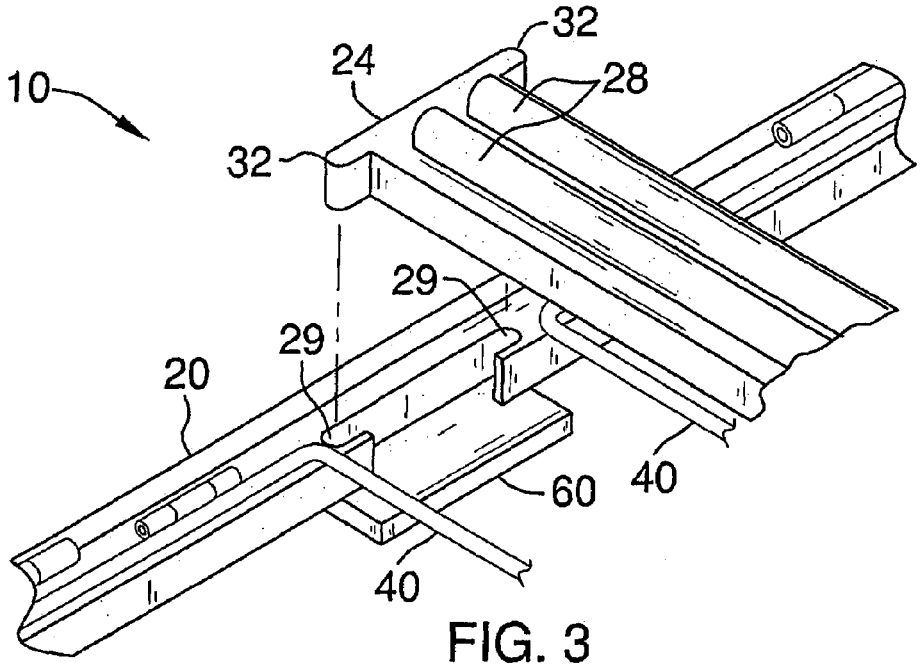
FIG. 3 is an enlarged perspective view of the apparatus shown in FIG. 1 showing the divider member.

The apparatus of this invention is referred to generally in FIGS. 1-3 by the reference numeral 10 and is intended to provide a bifurcated trash bin. It should be understood that the apparatus 10 may be used to collect many different types of waste materials and should not be limited to only collecting trash and recyclables.

Referring initially to FIG. 1, the apparatus 10 includes a generally rectangular housing 20 provided with a centrally disposed longitudinal axis and further has an open top portion 21 and a closed bottom portion 22 axially spaced therefrom. Such a housing 20 defines a cavity 23 therein and includes a divider member 24 removably positionable along the top portion 21 wherein the divider member 24 traverses the axis along a substantially horizontal plane. The divider member 24 bifurcates the cavity 23 into a pair of juxtaposed and substantially symmetric partitions for conveniently maintaining separate trash bags 30 therein. This feature advantageously allows for the separation of two different types of trash, such as recyclable and non-recyclable. Of course, the separate trash bags 30 may also be used to separate other types of waste such as hazardous waste and non-hazardous waste, for example.

Still referring to FIG. 1, a plurality of rectangular lids 25 are pivotally and independently connected to the housing 20 adjacent to the top portion 21. Such lids 25 are independently and selectively movable between raised and lowered positions along respective arcuate paths for covering the open top portion 21 of the housing 20, advantageously blocking the contents of the trash bags 30 from an observer's view. The lids 25 pivot about a first axis extending orthogonal to the longitudinal axis. The lids 25 include outer edge portions 26 and a central surface 27 integral therewith that is engageable with the lip portions 51 (described herein below) and the lip protrusions 52 (described herein below) when moved to lowered positions respectively.

Still referring to FIG. 1, a plurality of bag-supporting members 40 are pivotally connected to the housing 20 adjacent to the lids 25 respectively. Such bag-supporting members 40 are sized and shaped for independently extending about associated perimeters of the partitions wherein top edge portions 31 of the trash bags 30 can be selectively engaged with the bag-supporting members 40 and securely held in place when the bag-supporting members 40 are pivoted to lowered positions respectively, thus ensuring proper function of the apparatus 10. The bag-supporting members 40 pivot about a second axis extending adjacent to the first axis and extending substantially parallel thereto.

Referring to FIGS. 1 and 2, a mechanism 50 for maintaining the lids 25 and the bag-supporting members 40 at closed positions is disposed about a partial perimeter of the housing 20. This feature ensures that the aesthetic appeal of the apparatus 10 is conserved by preventing the unsightly exposure of the trash contained therein. Such a maintaining mechanism 50 includes a plurality of lip portions 51 secured to the housing 20 and extending upwardly therefrom. The lip portions 51 are oppositely spaced from the divider member 24 and extend substantially parallel thereto. Each such lip portion 51 has a generally L-shape and includes a protrusion 52 integrally disposed along a length thereof. The protrusions 52 partially extend into the arcuate paths of the bag-support members 40 so that a frictional force can be generated therebetween and advantageously hold the trash bags 30 at operating positions. The divider member 24 includes a plurality of protrusions 28 extending along a length thereof for cooperating with the lip protrusions 52 to support the trash bags 30 at stable positions.

Referring to FIG. 3, a plurality of stop members 60 are connected to the housing 20 and disposed adjacent to the top portion 21. Such stop members 60 extend inwardly from a perimeter of the housing 20 and define a platform above which the divider member 24 is supported. The housing 20 further has a plurality of slots 29 formed therein vertically above the stop members 60 wherein the slots 29 are sized and shaped for mating with the divider member 24. Such a divider member 24 has opposed end portions including integrally disposed flange portions 32 extending outwardly and away therefrom for selectively fitting through the slots 29 and resting on the stop members 60 respectively so that the divider member 24 can be maintained along the horizontal plane.

Referring to FIG. 1, a plurality of levers 70 are pivotally attached to the housing 20 adjacent to the front end portions of the partitions respectively. Such levers 70 are for assisting a user to conveniently disengage the lids 25 and the bag-supporting members 50 upwardly and away from the housing 20 during operating conditions respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for receiving and storing disposable items therein, said apparatus comprising:

a housing provided with a centrally disposed longitudinal axis and having an open top portion and a closed bottom portion axially spaced therefrom, said housing defining a cavity therein and including a divider member removably positionable along said top portion wherein said divider member traverses the axis along a substantially horizontal plane, said divider member for bifurcating the cavity into a pair of juxtaposed partitions for maintaining separate trash bags therein;

a plurality of lids pivotally independently connected to said housing and adjacent to said top portion, said lids being independently and selectively movable between raised and lowered positions along respective arcuate paths for covering said open top portion of said housing;

a plurality of bag-supporting members pivotally connected to said housing adjacent said lids respectively, said bag-supporting members being sized and shaped for extending about associated perimeters of said partitions wherein top edge portions of the trash bags can be selectively engaged with said bag-supporting members and securely held in place when said bag-supporting members are pivoted to lowered positions respectively; and means for maintaining said lids and said bag-supporting members at closed positions wherein said maintaining means is disposed about a partial perimeter of said housing;

wherein said maintaining means comprises a plurality of lip portions secured to said housing and extending upwardly therefrom, said lip portions being oppositely spaced from said divider member and extending substantially parallel thereto, each said lip portion having a generally L-shape and including a protrusion integrally disposed along a length thereof, said protrusions partially extending into the arcuate paths of said bag-support members so that a frictional force can be generated therebetween and hold the trash bags at operating positions, said divider member including a plurality of protrusions extending along a length thereof for cooperating with said lip protrusions and to support the trash bags at stable positions;

wherein said lids comprise: outer edges portions and a central surface integral therewith and engageable with said lip portions and said lip protrusions when moved to lowered positions respectively.

2. The apparatus of claim 1, further comprising: a plurality of stop members connected to said housing and disposed adjacent to said top portion, said stop members extending inwardly from a perimeter of said housing and defining a platform above which said divider member is supported, said housing further having a plurality of slots formed therein and vertically above said stop members wherein the slots are sized and shaped for mating with said divider member, said divider member having opposed end portions including integrally disposed flange portions extending outwardly and away therefrom for selectively fitting through the slots and resting on said stop members respectively so that said divider member can be maintained along the horizontal plane.

3. The apparatus of claim 1, further comprising: a plurality of levers attached to said housing adjacent front end portions of said partitions respectively, said levers for assisting a user to disengage said lids and said bag-supporting members upwardly and away from said housing during operating conditions respectively.

4. An apparatus for receiving and storing disposable items therein, said apparatus comprising:

a generally rectangular housing provided with a centrally disposed longitudinal axis and having an open top portion and a closed bottom portion axially spaced therefrom, said housing defining a cavity therein and including a divider member removably positionable along said top portion wherein said divider member traverses the axis along a substantially horizontal plane, said divider member for bifurcating the cavity into a pair of juxtaposed partitions for maintaining separate trash bags therein;

a plurality of rectangular lids pivotally independently connected to said housing and adjacent to said top portion, said lids being independently and selectively movable between raised and lowered positions along respective arcuate paths for covering said open top portion of said housing;

a plurality of bag-supporting members pivotally connected to said housing adjacent said lids respectively, said bag-supporting members being sized and shaped for independently extending about associated perimeters of said partitions wherein top edge portions of the trash bags can be selectively engaged with said bag-supporting members and securely held in place when said bag-supporting members are pivoted to lowered positions respectively; and means for maintaining said lids and said bag-supporting members at closed positions wherein said maintaining means is disposed about a partial perimeter of said housing;

wherein said maintaining means comprises a plurality of lip portions secured to said housing and extending upwardly therefrom, said lip portions being oppositely spaced from said divider member and extending substantially parallel thereto, each said lip portion having a generally L-shape and including a protrusion integrally disposed along a length thereof, said protrusions partially extending into the arcuate paths of said bag-support members so that a frictional force can be generated therebetween and hold the trash bags at operating positions, said divider member including a plurality of protrusions extending along a length thereof for cooperating with said lip protrusions and to support the trash bags at stable positions;

a plurality of stop members connected to said housing and disposed adjacent to said top portion, said stop members extending inwardly from a perimeter of said housing and defining a platform above which said divider member is supported, said housing further having a plurality of slots formed therein and vertically above said stop members wherein the slots are sized and shaped for mating with said divider member, said divider member having opposed end portions including integrally disposed flange portions extending outwardly and away therefrom for selectively fitting through the slots and resting on said stop members respectively so that said divider member can be maintained along the horizontal plane.

5. The apparatus of claim 4, wherein said lids comprise: outer edges portions and a central surface integral therewith and engageable with said lip portions and said lip protrusions when moved to lowered positions respectively.

6. The apparatus of claim 4, further comprising: a plurality of levers attached to said housing adjacent front end portions of said partitions respectively, said levers for assisting a user to disengage said lids and said bag-supporting members upwardly and away from said housing during operating conditions respectively.

7. An apparatus for receiving and storing disposable items therein, said apparatus comprising:

a generally rectangular housing provided with a centrally disposed longitudinal axis and having an open top portion and a closed bottom portion axially spaced therefrom, said housing defining a cavity therein and including a divider member removably positionable along said top portion wherein said divider member traverses the axis along a substantially horizontal plane, said divider member for bifurcating the cavity into a pair of juxtaposed and substantially symmetric partitions for maintaining separate trash bags therein, said divider member extending parallel to the horizontal plane wherein said divider member remains spaced above a bottom surface of said housing;

a plurality of rectangular lids pivotally independently connected to said housing and adjacent to said top portion, said lids being independently and selectively movable between raised and lowered positions along respective and independent arcuate paths for covering said open top portion of said housing, said lids independently pivoting about a first axis extending orthogonal to the longitudinal axis such that a first one of said lids remains at a closed position while a second one of said lids freely pivots between closed and open positions along an associated one of said arcuate paths;

a plurality of bag-supporting members pivotally connected to said housing adjacent said lids respectively, said bag-supporting members being sized and shaped for independently extending about associated perimeters of said partitions wherein top edge portions of the trash bags can be selectively engaged with said bag-supporting members and securely held in place when said bag-supporting members are pivoted to lowered positions respectively, said bag-supporting member pivoting about a second axis extending adjacent said first axis and extending substantially parallel thereto; and means for maintaining said lids and said bag-supporting members at closed positions wherein said maintaining means is disposed about a partial perimeter of said housing;

wherein said maintaining means comprises a plurality of lip portions secured to said housing and extending upwardly therefrom, said lip portions being oppositely spaced from said divider member and extending substantially parallel thereto, each said lip portion having a generally L-shape and including a protrusion integrally disposed along a length thereof, said protrusions partially extending into the arcuate paths of said bag-support members so that a frictional force can be generated therebetween and hold the trash bags at operating positions, said divider member including a plurality of protrusions extending along a length thereof for cooperating with said lip protrusions and to support the trash bags at stable positions, wherein respective top edges of the trash bags are intercalated between said bag-supporting members and said protrusions such that said top edge of said trash bags travels beneath said bag-supporting members and over said protrusions, wherein said ton edges travel about a top perimeter of said protrusions and terminate laterally away therefrom.

8. The apparatus of claim 7, further comprising: a plurality of stop members connected to said housing and disposed adjacent to said top portion, said stop members extending inwardly from a perimeter of said housing and defining a platform above which said divider member is supported, said housing further having a plurality of slots formed therein and vertically above said stop members wherein the slots are sized and shaped for mating with said divider member, said divider member having opposed end portions including integrally disposed flange portions extending outwardly and away therefrom for selectively fitting through the slots and resting on said stop members respectively so that said divider member can be maintained along the horizontal plane.

9. The apparatus of claim 7, wherein said lids comprise: outer edges portions and a central surface integral therewith and directly engaged with said lip portions and said lip protrusions when moved to lowered positions respectively.

10. The apparatus of claim 7, further comprising: a plurality of levers attached to a top edge of said housing and extending upwardly therefrom adjacent to front end portions of said partitions respectively, said levers for assisting a user to disengage said lids and said bag-supporting members upwardly and away from said housing during operating conditions respectively.

* * * * *